US009941641B1

(12) United States Patent
Jiang et al.

(10) Patent No.: US 9,941,641 B1
(45) Date of Patent: Apr. 10, 2018

(54) MALE CONNECTOR

(71) Applicant: Amphenol East Asia Electronic Technology (Shen Zhen) Co., Ltd., Shenzhen (CN)

(72) Inventors: Fuan Jiang, Shenzhen (CN); Xiang Wang, Shenzhen (CN); Lei Liao, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/610,750

(22) Filed: Jun. 1, 2017

(51) Int. Cl.
*H01R 13/6585* (2011.01)
*H01R 13/6599* (2011.01)
*H01R 13/631* (2006.01)

(52) U.S. Cl.
CPC ..... *H01R 13/6585* (2013.01); *H01R 13/631* (2013.01)

(58) Field of Classification Search
CPC ..... H01R 13/6585–13/6589; H01R 13/6599; H01R 13/65802; H01R 13/65807; H01R 13/2414; H01R 13/53; H01R 23/688; H01R 23/7073; H01R 23/6873
USPC ..... 439/86, 88, 607.02, 607.05, 607.08
See application file for complete search history.

(56) References Cited

U.S. PATENT DOCUMENTS 2,392,429 A * 1/1946 Sykes ..... H03H 9/09 29/25.35
3,140,342 A * 7/1964 Avery ..... F16J 15/06 174/356
3,187,226 A * 6/1965 Kates ..... H01L 23/36 165/80.3
3,969,816 A * 7/1976 Swengel, Sr. ..... H05K 3/222 174/251
8,297,969 B2 * 10/2012 Daneri ..... F23D 14/22 431/11
8,480,413 B2 * 7/2013 Minich ..... H01R 12/724 439/607.05
8,808,029 B2 * 8/2014 Castillo ..... H01R 13/6585 439/607.05
8,858,243 B2 * 10/2014 Luo ..... H01R 13/652 439/108
9,022,800 B2 * 5/2015 Yang ..... H01R 13/6581 439/487
9,577,364 B2 * 2/2017 Huo ..... H01R 13/516
2014/0024257 A1 * 1/2014 Castillo ..... H01R 13/6585 439/607.05
2015/0244111 A1 * 8/2015 Ju ..... H01R 13/6585 439/607.05

(Continued)

*Primary Examiner* — Gary Paumen
(74) *Attorney, Agent, or Firm* — Maier & Maier, PLLC

(57) ABSTRACT

A new connector with effective shielding function. The new connector includes conductive shielding, a connector body and a set of terminals. The connector body is provided with a cavity within which the set of terminals can be accommodated and is made from plastic cement; the set of terminals are located within the cavity of the connector body. The conductive shielding can be inserted between the connector body and the set of terminals, and specifically includes several shielding bars and conductive areas; the shielding bars are made from metal, and the conductive areas, which are embedded in the shielding bars and connected with the ends of the set of terminals, are made from conductive plastic cement.

2 Claims, 2 Drawing Sheets

(56) References Cited

U.S. PATENT DOCUMENTS

| | | | | |
|---|---|---|---|---|
| 2016/0118750 | A1* | 4/2016 | Guo | H01R 13/6585<br>439/78 |
| 2016/0149349 | A1* | 5/2016 | Kao | H01R 13/6586<br>439/607.05 |

* cited by examiner

MALE CONNECTOR

TECHNICAL FIELD

The present application relates to a male connector, particularly to a new connector with effective shielding function.

BACKGROUND

As the data storing capacity continues to rise, the demand for higher transmission rate has been on the increase, which means the increase of clock frequency and dramatic decrease of the rise time in the server storing industry. The SAS and PCIe channels of most current connectors will be subject to crosstalk during communication when used simultaneously, which should be avoided.

SUMMARY OF THE APPLICATION

To resolve the above described technical problems, the present application provides a connector with effective electromagnetic shielding function.

To achieve the above described objective, the technical solutions of the application are detailed as follows: a new male connector comprises a conductive shielding, a connector body and a set of terminals.

The connector body, which is made from plastic cement, is provided with a cavity within which the set of terminals can be accommodated. The set of terminals are located within the cavity of the connector body. The conductive shielding can be inserted between the connector body and the set of terminals, and the conductive shielding specifically includes several shielding bars and conductive areas. The bar shaped shielding bars are made from metal, and the conductive areas, which are embedded in the shielding bars and connected with the ends of the set of terminals, are made from conductive plastic cement.

In a further optimized technical solution, the new male connector includes two fixing tabs respectively located at the two sides of the connector body.

Compared with the existing technical solutions, the beneficial effects of the present application lie in that: the present male connector has an effective electromagnetic shielding function, the innovation point is that its conductive plastic cement box is integrated with its shielding tab, forming the conductive shielding; specifically, the conductive shielding is located between the set of terminals to eliminate the crosstalk caused when the upper and lower rows of terminals transmit signals simultaneously, and in the meantime all ground terminals are connected via conductive plastic cement to reduce crosstalk.

The conductive shielding resolves the problem of signal crosstalk caused by simultaneous usage of SAS and PCIe channels and the problem of the current products that only four channels (X4) of PCIe can be used, making full use of all SAS and PCIe channels and to increase the number of channels to six (X6). Further, the number of channels can be increased from six (X6) to eight (X8) in the future.

DETAILED DESCRIPTION

Figure 1:
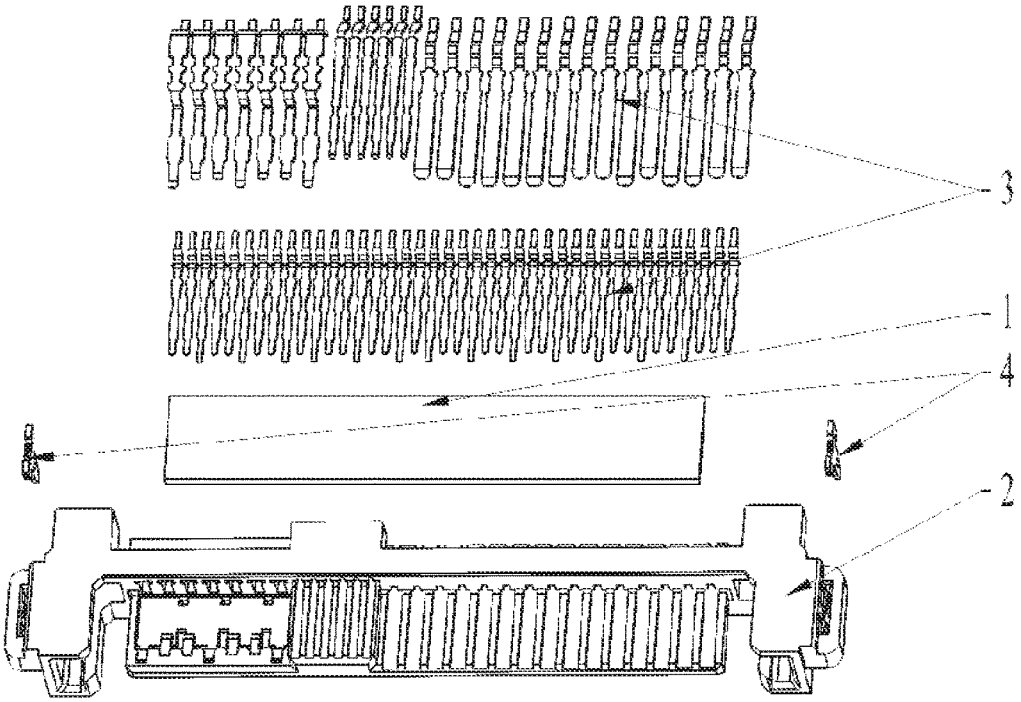
FIG. 1 is an exploded view of a new male connector.
Figure 2:
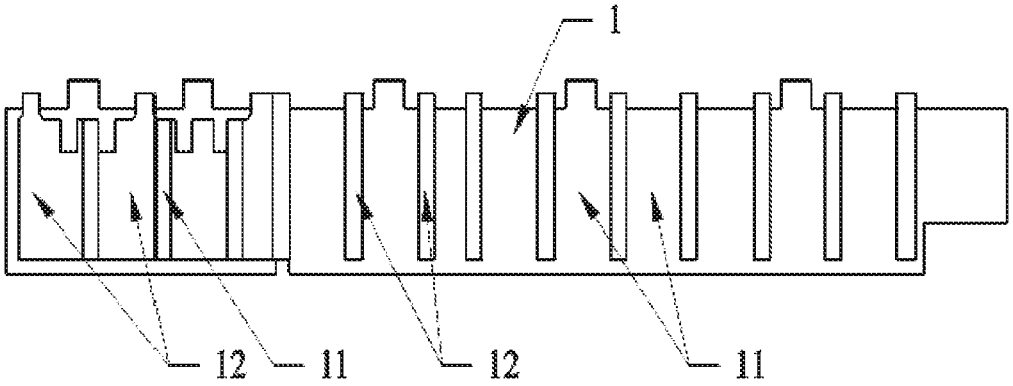
FIG. 2 is an elevation view of the conductive shielding.
Figure 3:
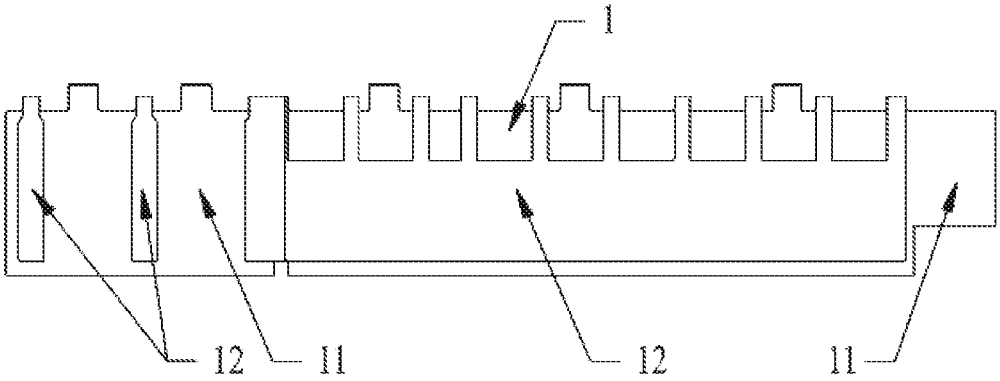
FIG. 3 is a rear view of the conductive shielding.

The present application will be detailed in connection with FIGS. 1 to 3 and the specific embodiments as well, which are in no way intended to limit the present application.

Embodiment 1

A new male connector comprises a conductive shielding 1, a connector body 2, a set of terminals 3, and two fixing tabs 4.

The connector body 2 is provided with a cavity within which the set of terminals 3 can be accommodated and is made from plastic cement. The set of terminals 3 are located within the cavity of the connector body 2. The conductive shielding 1 can be inserted between the connector body 2 and the set of terminals 3, and specifically includes several shielding bars 11 and conductive areas 12. The bar shaped shielding bars 11 are made from metal, and the conductive areas 12, which are embedded in the shielding bars 11 and connected with the ends of the set of terminals 3, are made from conductive plastic cement.

The fixing tabs 4 are respectively located at the two sides of the connector body 2.

In light of general technical knowledge, the present technical solutions can be achieved by other embodiments which do not depart from the spiritual substance or essential features of the application. Therefore, the above described embodiments are simply illustrative rather than exclusive in any way. All the changes within the range of the application or its equivalent are included in the application itself.

The invention claimed is:

1. A new male connector, comprising: a conductive shielding, a connector body and a set of terminals; wherein the connector body is provided with a cavity within which the set of terminals can be accommodated and is made from plastic cement; and the set of terminals are located within the cavity of the connector body;

wherein the conductive shielding can be inserted between the connector body and the set of terminals, and specifically includes several shielding bars and conductive areas;

wherein the shielding bars are of bar shape and made from metal, and the conductive areas, which are embedded in the shielding bars and connected with the ends of the set of terminals, are made from conductive plastic cement.

2. The new male connector as set forth in claim 1, further comprising two fixing tabs respectively located at the two sides of the connector body.

* * * * *